US009844690B2

(12) United States Patent
Chung et al.

(10) Patent No.: US 9,844,690 B2
(45) Date of Patent: Dec. 19, 2017

(54) FIRE EXTINGUISHING APPLIANCE ADJUSTABLE IN FOAM EXPANSION RATIO

(71) Applicants: Kee-Chiang Chung, Yunlin County (TW); Chun-Hsiang Hsu, Hsinchu (TW)

(72) Inventors: Kee-Chiang Chung, Yunlin County (TW); Chun-Hsiang Hsu, Hsinchu (TW)

( * ) Notice: Subject to any disclaimer, the term of this patent is extended or adjusted under 35 U.S.C. 154(b) by 0 days.

(21) Appl. No.: 14/832,706

(22) Filed: Aug. 21, 2015

(65) Prior Publication Data

US 2016/0263411 A1 Sep. 15, 2016

(30) Foreign Application Priority Data

Mar. 13, 2015 (TW) ..... 104203775 U

(51) Int. Cl.
*A62C 13/00* (2006.01)
*A62C 5/02* (2006.01)
*A62C 13/64* (2006.01)

(52) U.S. Cl.
CPC ..... *A62C 13/003* (2013.01); *A62C 5/022* (2013.01); *A62C 13/64* (2013.01)

(58) Field of Classification Search
CPC ..... A62C 13/003; A62C 5/022; A62C 13/64
USPC ..... 169/74
See application file for complete search history.

(56) References Cited

U.S. PATENT DOCUMENTS 5,018,584 A * 5/1991 Tomlinson ..... A62C 25/00 169/13
5,054,688 A * 10/1991 Grindley ..... B05B 7/005 169/15
5,137,094 A * 8/1992 Broussard ..... A62B 17/003 169/15
5,160,071 A * 11/1992 Wright ..... B05B 11/3045 222/324
5,165,442 A * 11/1992 Grindley ..... A62C 5/02 137/101.11
5,228,624 A * 7/1993 Mensink ..... B05B 7/10 239/405
6,113,004 A * 9/2000 Steingass ..... A62C 5/02 169/30

* cited by examiner

*Primary Examiner* — Arthur O Hall
*Assistant Examiner* — Chee-Chong Lee
(74) *Attorney, Agent, or Firm* — Ming Chow; Sinorica, LLC

(57) ABSTRACT

A fire extinguishing appliance adjustable in foam expansion ratio includes a main body, a spray-head seat connected with the main body, and a guide unit. The main body is provided with an agent chamber received therein with a non-toxic agent, while the guide unit is formed with an inlet, an outlet and an inner wall having a damping piece mounted thereon. Thus, when the non-toxic agent is actuated to pass through the inlet and get into the guide unit, the non-toxic agent will collide with the damping piece and rotate to carry out foaming, able to enhance the foam expansion ratio, the mixing efficiency and the fire extinguishing efficiency of the non-toxic agent.

5 Claims, 8 Drawing Sheets

FIRE EXTINGUISHING APPLIANCE ADJUSTABLE IN FOAM EXPANSION RATIO

The current application claims a foreign priority to application number 104203775 filed on Mar. 13, 2015 in Taiwan

BACKGROUND OF THE INVENTION

1. Field of the Invention

This invention relates to a fire extinguishing spray-head device, particularly to a fire extinguishing appliance adjustable in foam expansion ratio for producing best fire extinguishing efficacy.

2. Description of the Prior Art

In order to extinguish fire in a shortest time, fire extinguishing apparatuses, such as extinguishers and automatic fire extinguishing systems installed in large buildings, are respectively provided with a nozzle at the front end of a pipe for spraying the fire extinguishing agent of the fire extinguishing apparatus and further for increasing a spraying range and distance so as to speed up fire extinguishing work and reduce loss of life and property.

However, the conventional nozzles are mostly bored with one or plural micro-pores at the front end for atomizing the fire extinguishing agent when the fire extinguishing agent passes through the nozzles, but such atomizing nozzles are unable to control foam expansion ratio and mixing efficiency of the fire extinguishing agent, thus unsatisfactory in fire extinguishing efficiency. Therefore, it is necessary how to devise a fire extinguishing appliance that is able to spray out water mist and controllable in water-spraying quantity for enhancing fire extinguishing efficiency.

SUMMARY OF THE INVENTION

The objective of this invention is to offer a fire extinguishing appliance adjustable in foam expansion ratio. The fire extinguishing appliance of this invention is provided with a damping piece to actuate non-toxic agent to rotate and collide with the damping piece when the non-toxic agent passes through the damping piece, thus able to enhance the foam expansion ratio, the mixing efficiency and the fire extinguishing efficacy of the non-toxic agent.

The fire extinguishing appliance adjustable in foam expansion ratio in the present invention includes a main body and a guide unit. The main body is formed therein with an agent chamber, and the pressure in the agent chamber is higher than that of the outside, having a non-toxic agent received in the agent chamber. The guide unit is connected with the main body and has its interior bored with a flow passageway having two ends respectively formed with an inlet and an outlet, having at least one inner wall formed between the inlet and the outlet. The guide unit has the inlet communicating with the agent chamber of the main body and the outlet communicating with the outside, with a damping piece mounted on the inner wall.

In use of the fire extinguishing appliance adjustable in foam expansion ratio, when the non-toxic agent in the agent chamber is actuated to get into the flow passageway along the inlet of the guide unit and passes through the damping piece, the non-toxic agent will rotate and extensively collide with air for increasing foam expansion ratio and mixing efficiency of the non-toxic agent. Thus, when the non-toxic agent is sprayed out of the outlet of the guide unit, the non-toxic agent is able to extinguishing fire for a large area, with quickness and with high efficiency.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
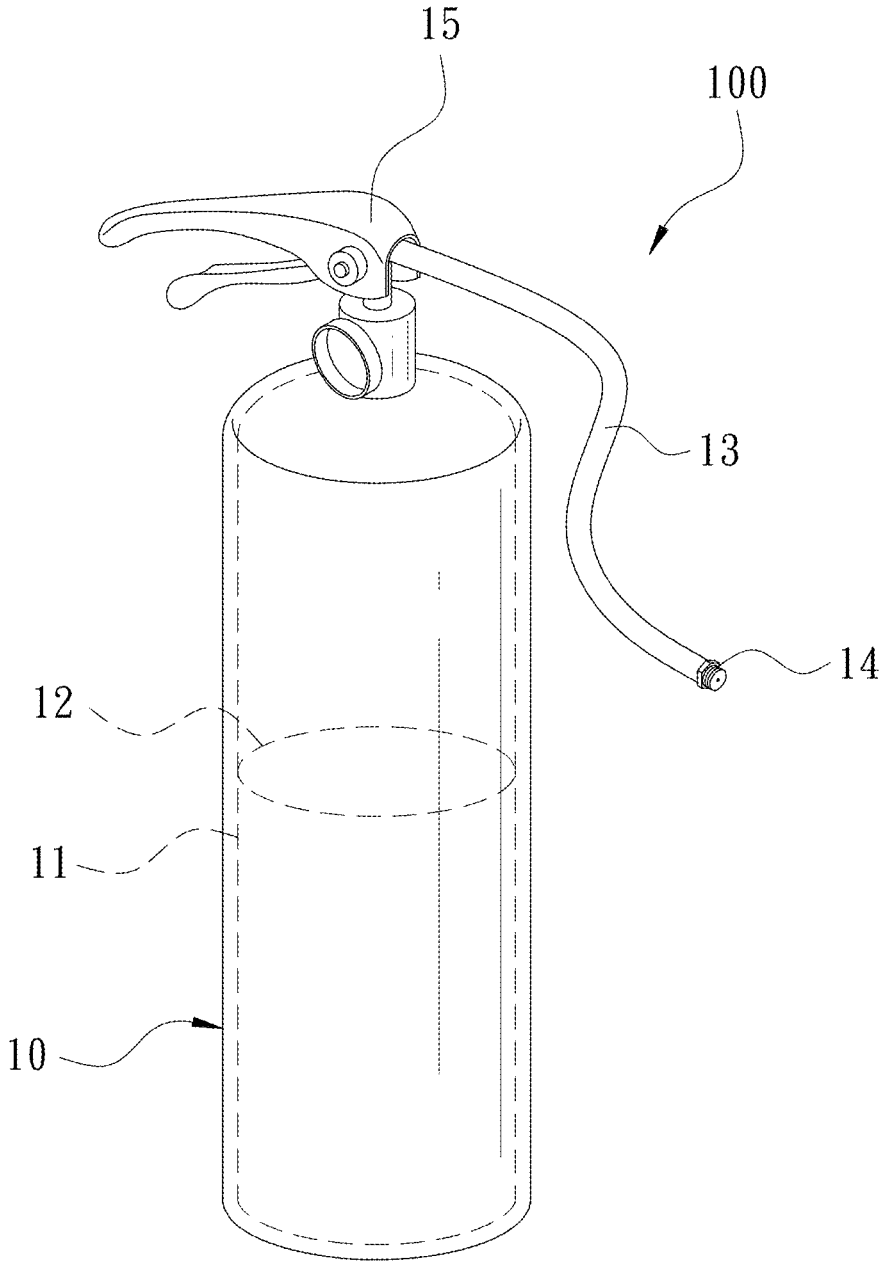
FIG. 1 is a perspective view of a first preferred embodiment of a fire extinguishing appliance adjustable in foam expansion ratio in the present invention.
Figure 2:
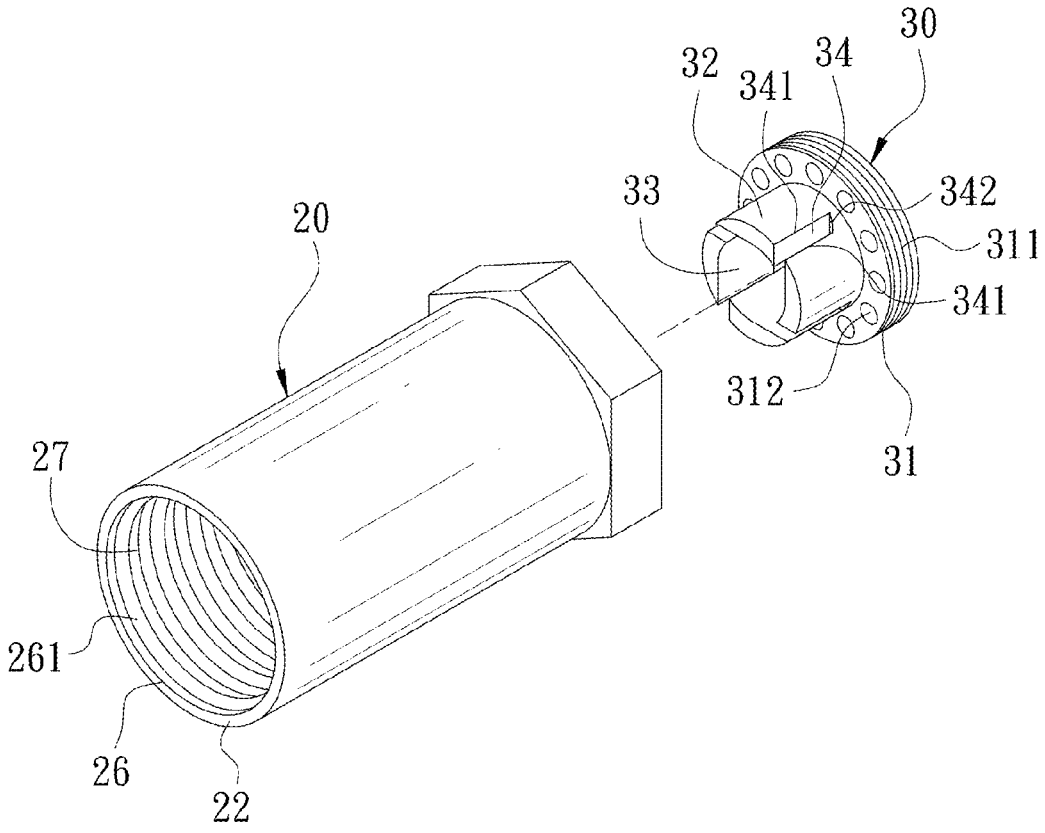
FIG. 2 is an exploded perspective view of the first preferred embodiment of a spray-head seat and a water guide member in the present invention.

A first preferred embodiment of a fire extinguishing appliance 100 adjustable in foam expansion ratio in the present invention, as shown in FIGS. 1 and 2, includes a main body 10, a spray-head seat and a water guide member 30 as main components combined together.

The main body 10 has its interior formed with an agent chamber 11 received therein with a non-toxic agent 12, and the pressure in the agent chamber 11 is higher than that of the outside. The main body 10 is coupled with a connecting pipe 13 communicating with the agent chamber 11 and having its free end provided with a combining screw thread 14 on the outer surface. In the first preferred embodiment, the main body 10 is a portable fire extinguishing steel cylinder that is provided with a lever switch 15, and the main body 10 has its interior filled with high pressure gas in advance, letting the pressure in the main body 10 become higher than that of the outside, so that the non-toxic agent 12 in the agent chamber 11 can be output when a user presses the lever switch 15.

Figure 3:
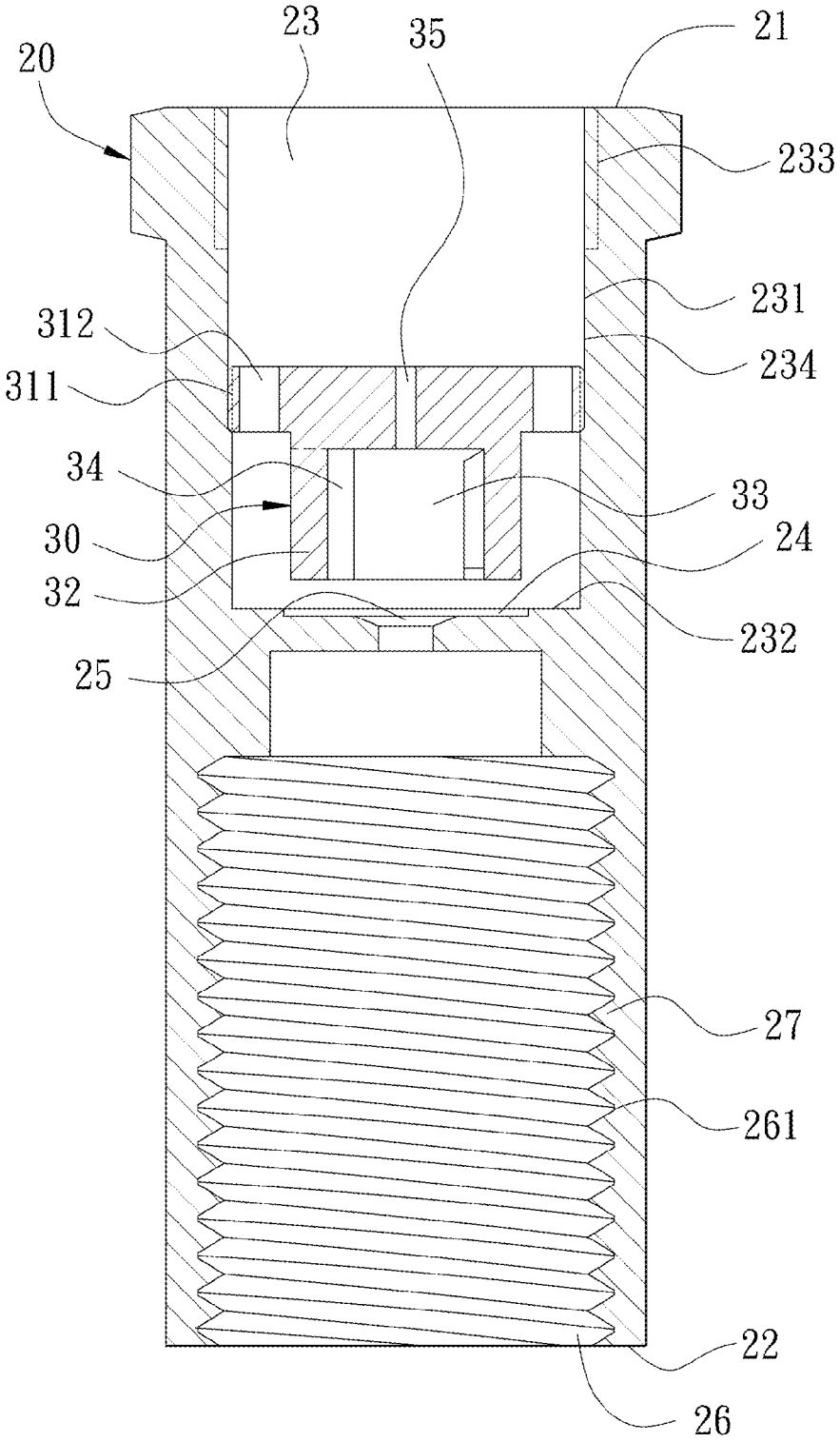
FIG. 3 is an axial cross-sectional view of the first preferred embodiment of the spray-head seat and the water guide member combined together in the present invention.
Figure 4:
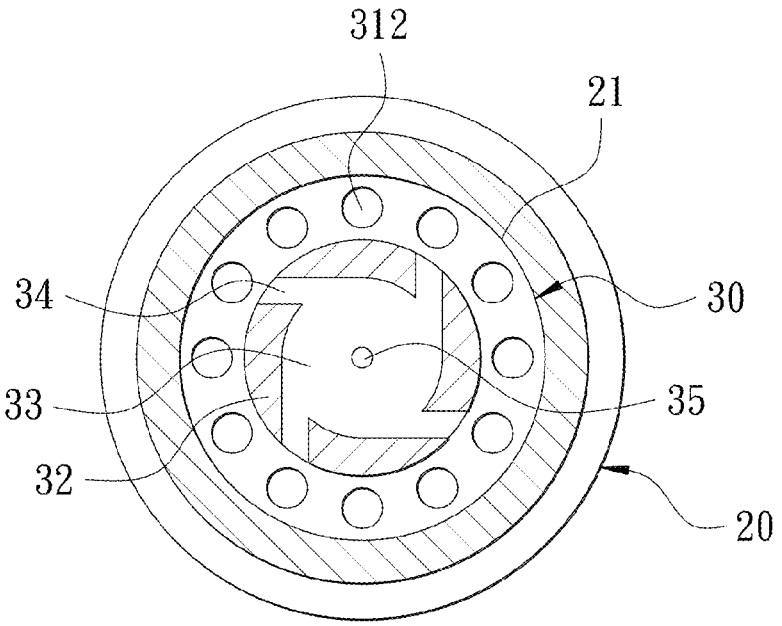
FIG. 4 is a radial cross-sectional view of the first preferred embodiment of the spray-head seat and the water guide member combined together in the present invention.

The spray-head seat 20, referring to FIGS. 3 and 4, is to be assembled with the connecting pipe 13, having its two axial ends respectively defined to be a first end face 21 and a second end face 22. The first end face 21 of the spray-head seat 20 is provided with a first accommodating groove 23, which is formed with a first inner ring surface 231 and a bottom surface 232. The first inner ring surface 231 of the spray-head seat 20 is provided with a first female thread 233 and a second female thread 234, and the spray-head seat 20 has the first female thread 233 fixedly screwed with the combining screw thread 14 of the main body 10. Further, the bottom surface 232 of the spray-head seat 20 is disposed with a recessed groove 24 and bored with a jet orifice 25 that is gradually contracted from the first end face 21 toward the second end face 22 and formed into a conical shape. The second end face 22 of the spray-head seat 20 is provided with a second accommodating groove 26, which is formed with a second inner ring surface 261, with the second accommodating groove 26 communicating with the first accommodating groove 23 via the jet orifice 25. The second inner ring surface 261 of the spray-head seat 20 is set with at least one damping piece 27, which is a screw in this preferred embodiment.

Figure 5:
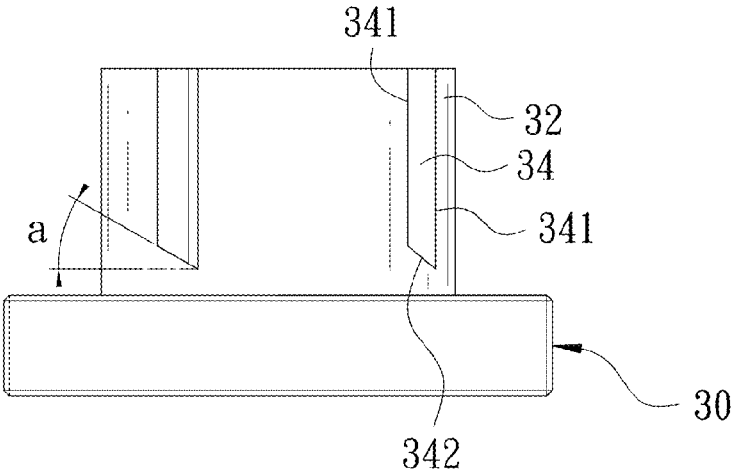
FIG. 5 is a side view of the first preferred embodiment of the water guide member in the present invention.

The water guide member 30, referring to FIGS. 2 and 5, is to be received in the first accommodating groove 23 of the spray-head seat 20, composed of a seat and a protruding ring 32 extending from one side surface of the seat 31, and the protruding ring 32 is smaller than the seat 31 in diameter. The seat 31 has its outer circumferential edge formed with a male thread 311 corresponding to the second female thread 234 of spray-head seat 20. The water guide member 30 can be combined with the spray-head seat 20 by the male thread 311 and the second female thread 234, and the second female thread 234 is longer than the male thread 311. Further, the seat 31 is axially bored with a plurality of through insert holes 312 spaced apart at the outer side of the protruding ring 32. The protruding ring 32 has its free end facing the jet orifice 25 and has its inner ring surface defined to form a volute chamber 33 corresponding with the jet orifice 25. The protruding ring 32 is axially cut with a plurality of flow passageways 34 spaced apart and communicating with the volute chamber 33. The flow passageways 34 are provided in the direction of tangent of the inner ring surface of the protruding ring 32, and the entrances of the flow passageways 34 are not opposite to one another. In this preferred embodiment, the flow passageways 34 are bored from the free end of the protruding ring 32 toward the seat 31, and each flow passageway 34 is formed with two side walls 341 and a bottom wall 342 between the two side walls 341, and an included angle (a) is formed by the bottom wall 342 with the radial direction of the protruding ring 32, letting the bottom wall 342 become a slant state, as shown in FIG. 5. In addition, the seat 31 is bored with a through hole 35 at a location corresponding to the central position of the protruding ring 32, with the through hole 35 communicating with the volute chamber 33.

Figure 6:
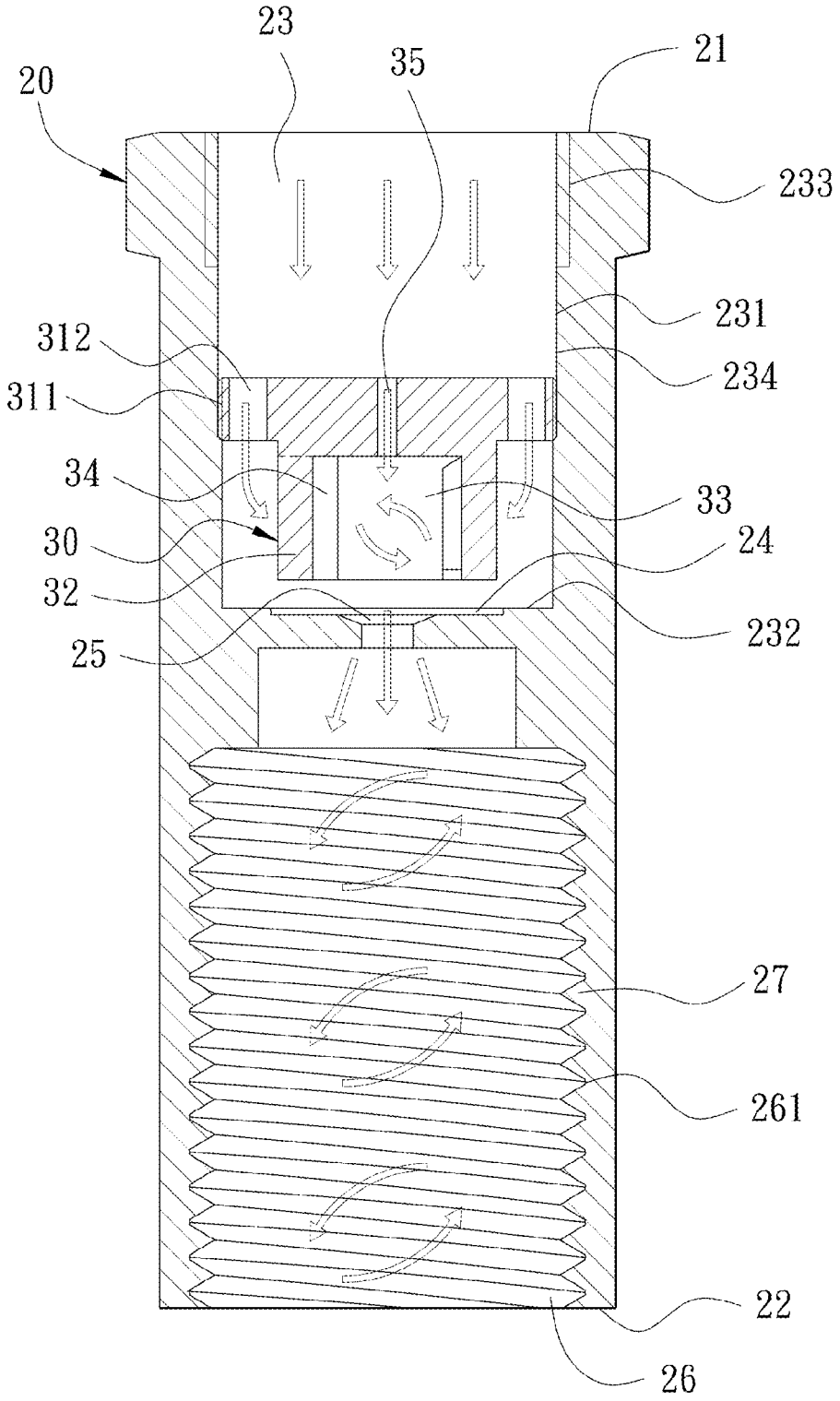
FIG. 6 is a schematic view of the first preferred embodiment of the fire extinguishing appliance in a using state in the present invention.

In using, referring to FIG. 6, when a fire breaks out, a user needs only to have the spray-head seat 20 aligned to the fire and press the lever switch 15 to force the non-toxic agent 12 in the agent chamber 11 to get into the first accommodating groove 23 of spray-head seat 20 through the connecting pipe 13 and then orderly pass through the insert holes 312 and the through hole 35 of the water guide member 30 and get into the volute chamber 33 via the flow passageways 34. At this time, since the flow passageways 34 are formed in the direction of tangent of the inner ring surface of the protruding ring 32; therefore, when the non-toxic agent 12 enters the volute chamber 33, the non-toxic agent 12 will move forward along the inner side wall of the volute chamber 33 and form a whirlpool state and thus, when passing through the jet orifice 25, the non-toxic agent 12 will be cast into the second accommodating groove 26 because of centrifugal force. Subsequently, the non-toxic agent 12 in the second accommodating groove 26 will be mixed with air and produce foam and, when passing through the screw thread of the damping piece 27, the non-toxic agent 12 will be actuated to rotate and extensively collide with air to enable the non-toxic agent 12 to enhance foam expansion ratio and mixing efficiency and lastly, the non-toxic agent 12 will be sprayed out of the second accommodating groove 26 of the spray-head seat 20, thus able to extinguish fire for a large area, with quickness and with high efficiency.

One special feature of this invention is that the second accommodating groove 26 is employed as a space for the non-toxic agent 12 to mix with air and carry out foaming and, when passing through the second accommodating groove 26, the non-toxic agent 12 will collide with the damping piece 27 and rotate for increasing the foam expansion ratio and the mixing efficiency of the non-toxic agent 12, thus enabling the non-toxic agent 12 to extinguish fire with high efficiency.

Another special feature of this invention is that the second female thread 234 of the spray-head seat 20 is longer than the male thread 311 of the water guide member 30; therefore, the position of the water guide member 30 at the second female thread 234 of the spray-head seat 20 can be adjusted via the male thread 311. Thus, the water guide member 30 can be assembled at different positions in the spray-head seat 20 so that the fire extinguishing appliance 100 adjustable in foam expansion ratio of this invention can be formed with different-sized foaming space for adjusting the foam expansion ratio and the mixing efficiency of the non-toxic agent 12. By so designing, foaming space, foam expansion ratio and fire extinguishing efficiency of all sorts of non-toxic agents can be adjusted.

Figure 7:
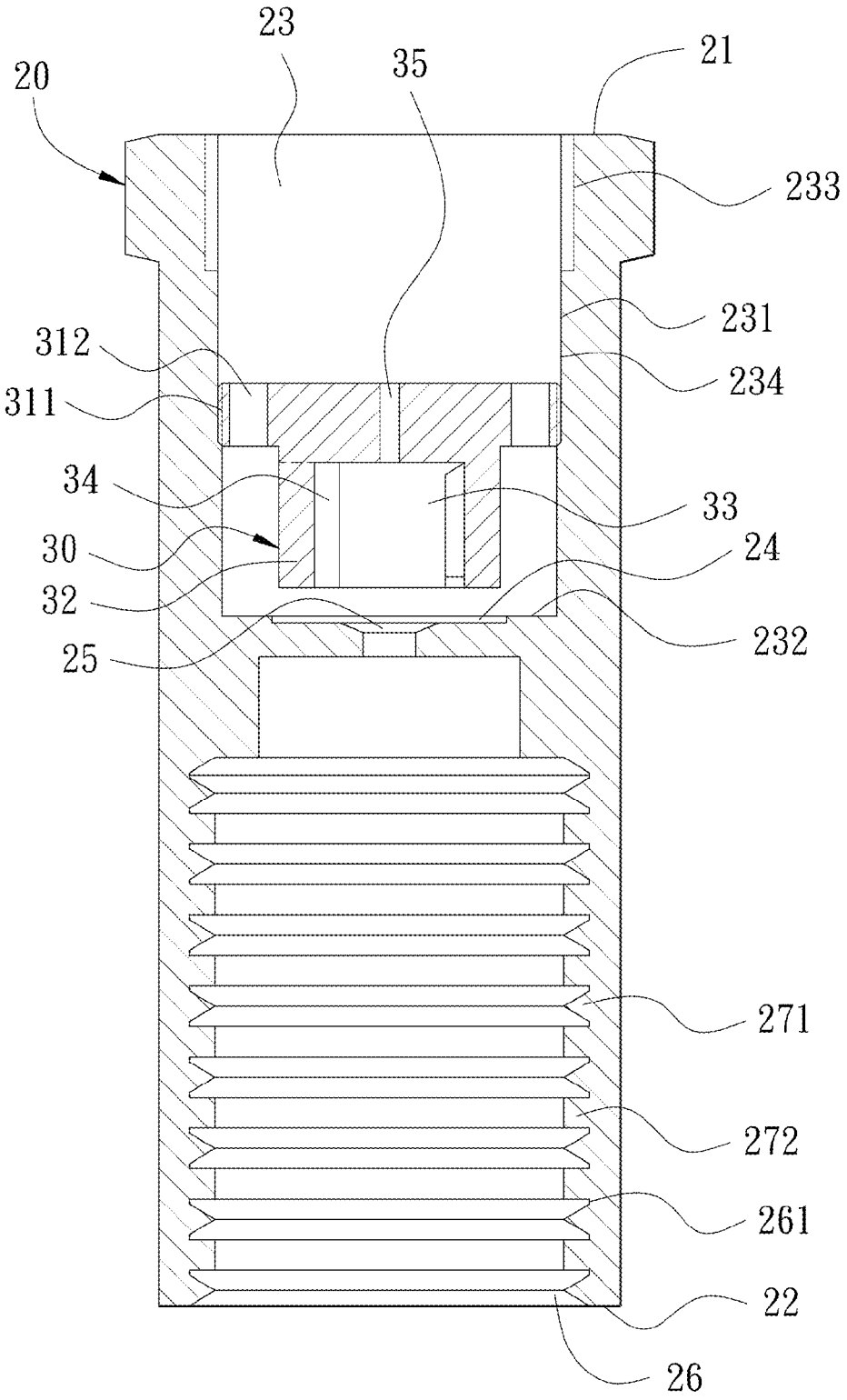
FIG. 7 is an axial cross-sectional view of a second preferred embodiment of a spray-head seat and a water guide member combined together in the present invention.

A second preferred embodiment of a fire extinguishing appliance adjustable in foam expansion ratio in the present invention, as shown in FIG. 7, is almost the same as the first preferred embodiment in structure, except that the damping piece 27 consists of plural square bulging rings 271 and triangular bulging rings 272. Thus, when the non-toxic agent 12 passes through the second accommodating groove 26, the non-toxic agent 12 will bump against the square bulging rings 271 and the triangular bulging rings 272 and rotate to increase the mixing strength and the mixing efficiency of the non-toxic agent 12 with air for enhancing the foam expansion ratio and the mixing efficiency of the non-toxic agent 12 to enable the non-toxic agent 12 to extinguish fire with high efficiency. Substantially, the damping piece 27 of this invention is not restricted to the screw thread, the square bulging rings and the triangular bulging rings disclosed in the first and the second preferred embodiments, but all that can bump against the non-toxic agent 12 for enhancing foam expansion ratio, mixing efficiency and fire extinguishing efficiency of the non-toxic agent 12 are available.

Figure 8:
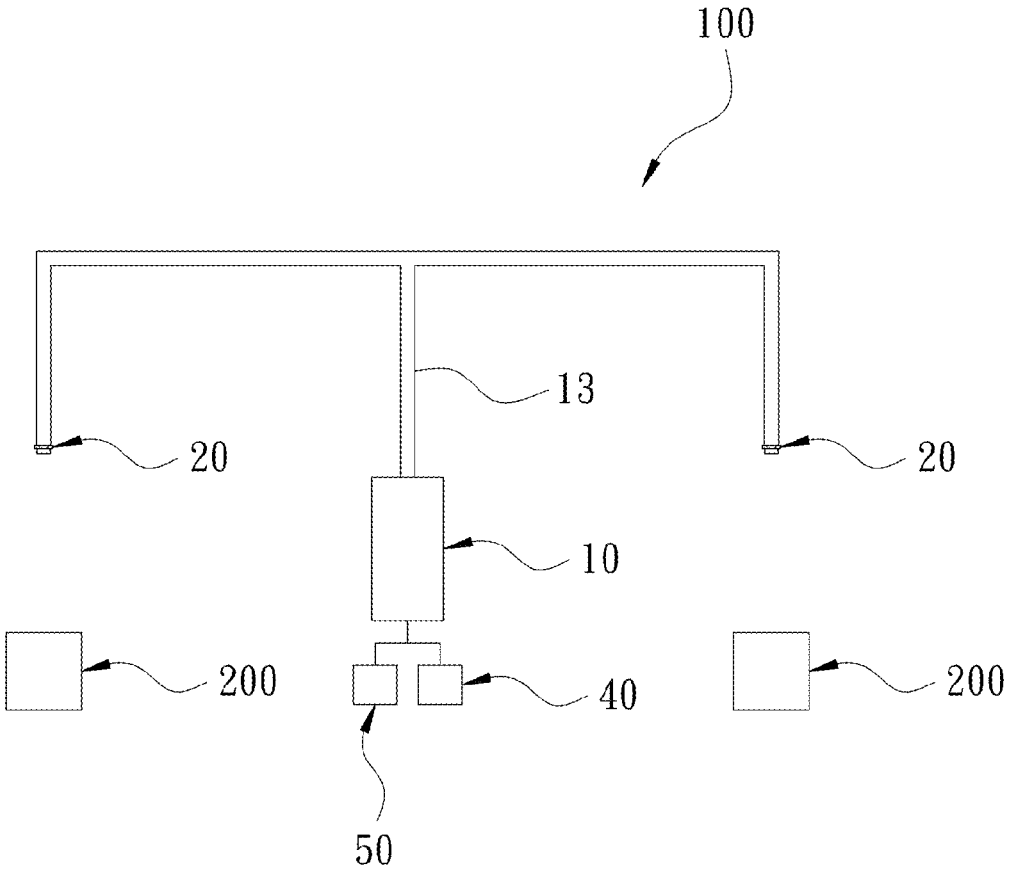
FIG. 8 is a system schematic view of a third preferred embodiment of a fire extinguishing appliance adjustable in foam expansion ratio in the present invention.

A third preferred embodiment of a fire extinguishing appliance 100 adjustable in foam expansion ratio in the present invention, as shown in FIG. 8, is different from foresaid preferred embodiments in structure. In the third preferred embodiment, the main body 10 is a fixed fire extinguishing water tank connected with a fire detector 40 and a gas supply unit 50, such as an air compressor or a gas cylinder. The main body 10 has the connecting pipe 13 connected with two spray-head seats 20, which are positioned over a combustible material 200. Thus, when the combustible material 200 catches fire and the fire is detected by the fire detector 40, the gas supply unit 50 will be started to have high pressure gas conveyed into the main body 10 to force the non-toxic agent 12 in the main body 10 to get to the spray-head seats 20 to be formed into fine water mist by the spray-head seats 20 for carrying out fire extinguishing work, thus equally attaining the same effect as described in foresaid preferred embodiments.

Figure 9:
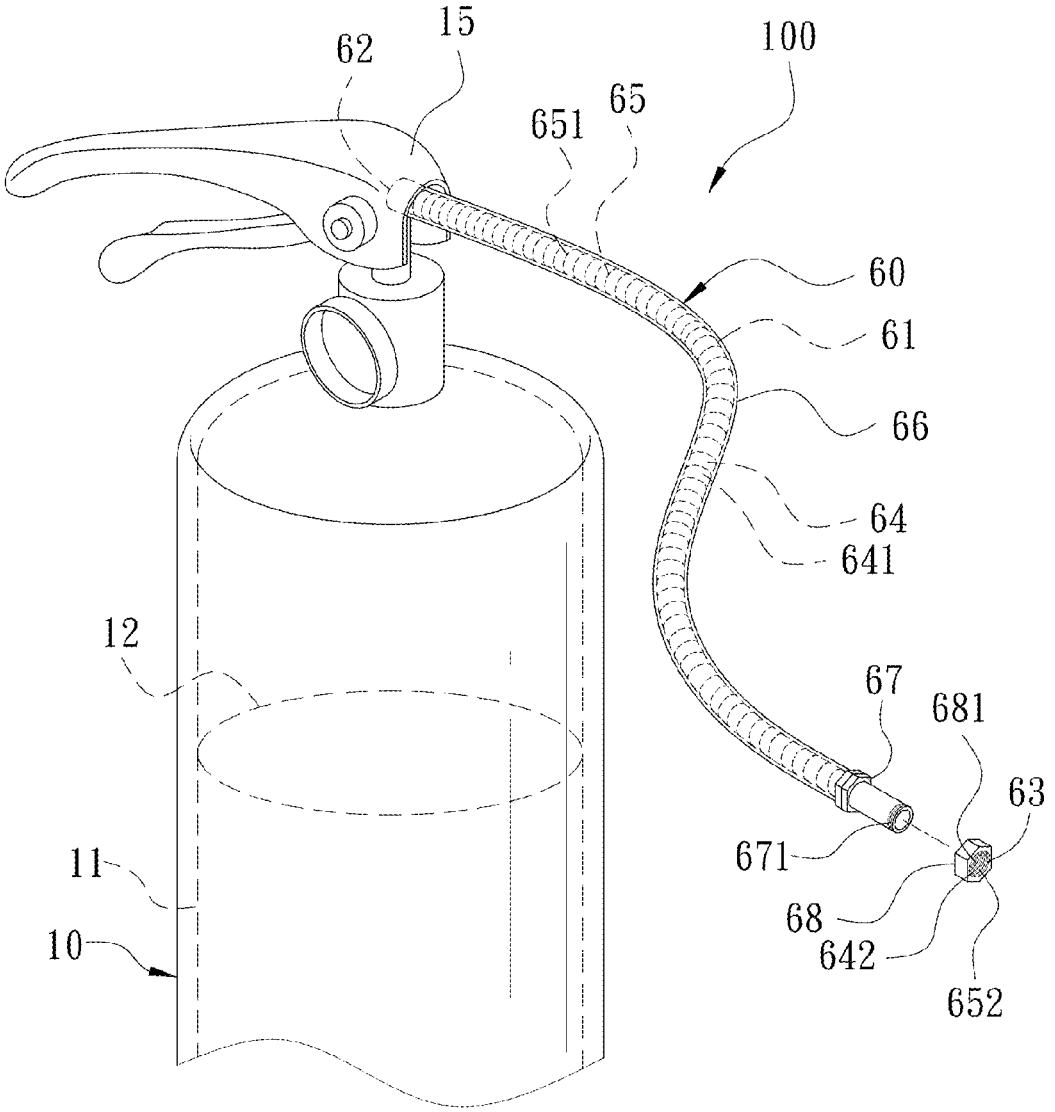
FIG. 9 is a perspective view of a fourth preferred embodiment of a fire extinguishing appliance adjustable in foam expansion ratio in the present invention.

A fourth preferred embodiment of a fire extinguishing appliance 100 adjustable in foam expansion ratio in the present invention, as shown in FIG. 9, is different from the first preferred embodiment in structure. The fire extinguishing appliance 100 adjustable in foam expansion ratio in the fourth preferred embodiment is provided with a guide unit 60 connected with the main body 10. The guide unit 60 has its interior bored with a through flow passageway 61 having two ends respectively formed with an inlet 62 and an outlet 63, and at least one inner wall 64 is formed between the inlet 62 and the outlet 63. The inlet 62 of the guide unit 60 communicates with the agent chamber 11 of the main body 10, while the outlet 63 of the guide unit 60 communicates with the outside, and the inner wall 64 of the guide unit 60 is provided thereon with a damping piece 65. In the fourth preferred embodiment, the guide unit 60 is composed of a connecting pipe 66, a spray-head seat 67 threadably connected with the connecting pipe 66, and a foaming member 68 combined with the spray-head seat 67, and the flow passageway 61 passes through the interior of the connecting pipe 66, the spray-head seat 67 and the foaming member 68. The connecting pipe 66 has one end formed with the inlet 62 and another end threadably connected with the spray-head seat 67. The free end of the spray-head seat has its outer circumference disposed with a first combining piece 671, which is a male thread, and the foaming member 68 is provided with a second combining piece 681, which is a female thread opposite to the first combining piece 671, and the foaming member 68 is foamed with the outlet 63. Further, the connecting pipe 66 is formed with an inner wall 641 mounted thereon with a damping piece 651, which is a screw, and the foaming member 68 is formed with an inner wall 642 provided thereon with a damping piece 652, which is a screw.

By so designing, when fire breaks out, a user needs only to have the spray-head seat 67 aligned to the fire and press the lever switch 15 to force the non-toxic agent 12 in the agent chamber 11 to get into the flow passageway 61 along the inlet 62 of the guide unit 60 and then orderly pass through the connecting pipe 66, the spraying-head seat 67 and the foaming member 68 and lastly, the non-toxic agent 12 will be sprayed out of the outlet 63 of the guide unit 60. When the non-toxic agent 12 passes through the screw of the damping pieces 651 and 652, the non-toxic agent 12 will be actuated to rotate and extensively collide with air for increasing the foam expansion ratio and the mixing efficiency of the non-toxic agent, thus able to extinguish fire for a large area, with quickness and with high efficiency.

What is worth mentioning is that, aside from having the connecting pipe 66 provided with the damping piece 651 and having the foaming member 68 provided with the damping piece 652, the inner wall 64 of the flow passageway 61 can be provided thereon with the damping piece 65 at any location for enhancing the foam expansion ratio and the mixing efficiency of the non-toxic agent 12.

Moreover, the connecting pipe 66 further contains a siphon tube and an agent conveyer tube connected with the siphon tube. The siphon tube has one end formed with the inlet 62 communicating with the agent chamber 11 of the main body 10, the inlet 62 being an agent suction inlet, and the agent conveyer tube has its free end provided with the outlet 63. Further, the siphon tube has an inner wall at the location of the inlet 62 mounted thereon with a spiral damping piece. Thus, the siphon tube of the guide unit 60 can function to suck agent for enhancing the foam expansion ratio and the mixing efficiency of the non-toxic agent 12.

While the preferred embodiments of the invention have been described above, it will be recognized and understood that various modifications may be made therein and the appended claims are intended to cover all such modifications that may fall within the spirit and scope of the invention.

What is claimed is:

1. A fire extinguishing appliance adjustable in foam expansion ratio comprising:

a main body;

the main body comprising an agent chamber;

the agent chamber forming an interior of the main body;

a pressure within the agent chamber being higher than a pressure of an outside;

a non-toxic agent;

the non-toxic agent being received within the agent chamber;

a connecting pipe;

the connecting pipe being coupled with the main body;

the connecting pipe being communicated with the agent chamber;

a spray-head seat;

the spray-head seat comprising two axial ends;

the two axial ends being respectively defined to be a first end face and a second end face;

the first end face comprising a first accommodating groove and a through jet orifice;

the first accommodating groove comprising a first inner ring surface and a bottom surface;

the first inner ring surface being assembled with the connecting pipe;

the through jet orifice being bored on the bottom surface;

the second end face comprising a second accommodating groove;

the second accommodating groove comprising a second inner ring surface;

the second accommodating groove being communicated with the first accommodating groove via the through jet orifice;

a damping piece;

the damping piece being mounted on the second inner ring surface;

a water guide member;

the water guide member being received in the first accommodating groove;

the water guide member comprising a seat and a protruding ring;

the protruding ring extending from one side surface of the seat;

the protruding ring being smaller than the seat in diameter;

the seat comprising a plurality of through insert holes axially bored therein;

the plurality of through insert holes being spaced apart from each other at an outer side of the protruding ring;

the protruding ring comprising a free end;

the free end surrounding the through jet orifice;

the protruding ring comprising an inner surface and a volute chamber;

the volute chamber being formed by the inner surface;

the volute chamber corresponding to the through jet orifice;

the protruding ring comprising a plurality of flow passageways cut thereon;

the plurality of flow passageways being spaced apart from each other and communicated with the volute chamber;

the first inner ring surface comprising a female thread;

the seat comprising an outer circumferential edge and a male thread;

the male thread being correspondingly disposed on the outer circumferential edge;

the seat being threadably fixed in the first accommodating groove via the female thread and the male thread; and the female thread being longer than the male thread.

2. The fire extinguishing appliance adjustable in foam expansion ratio as claimed in claim 1 comprising:

the first inner ring surface comprising another female thread;

the connecting pipe comprising an outer surface and a combining thread;

the combining thread being formed on the outer surface; and the connecting pipe being fixedly combined with the spray-head seat via the another female thread and the combining thread.

3. The fire extinguishing appliance adjustable in foam expansion ratio as claimed in claim 1 comprising:

the first end face comprising a recessed groove;

the recessed groove being formed on the bottom surface;

the recessed groove surrounding the through jet orifice; and the free end being positioned to face the recessed groove.

4. The fire extinguishing appliance adjustable in foam expansion ratio as claimed in claim 1 comprising:

a gas supply unit; and the gas supply unit being connected with the main body.

5. The fire extinguishing appliance adjustable in foam expansion ratio as claimed in claim 1 comprising:

the damping piece being a screw or a bulging block.

* * * * *